United States Patent [19]

Bond

[11] Patent Number: 4,637,243

[45] Date of Patent: Jan. 20, 1987

[54] PRESS LINKAGE WITH CONTROLLED DWELL

[76] Inventor: Irvin D. Bond, 10270 Allen Rd., Clarkston, Mich. 48016

[21] Appl. No.: 772,037

[22] Filed: Sep. 3, 1985

[51] Int. Cl.[4] ..... B21J 13/10

[52] U.S. Cl. ..... 72/421; 72/426; 72/422; 74/110; 83/82; 83/277; 414/753

[58] Field of Search ..... 72/421, 422, 425, 426, 72/427, 419, 405, 345, 346; 414/749, 751, 753, 905; 74/110; 83/153, 82, 277; 198/485.1, 486.1; 100/207, 215

[56] References Cited

U.S. PATENT DOCUMENTS

| | | | |
|---|---|---|---|
| 2,305,064 | 12/1942 | Colwell et al. | 72/405 |
| 2,314,123 | 3/1943 | Butterfield | 72/427 |
| 2,667,853 | 2/1954 | Ingersoll | 72/345 |
| 3,080,983 | 3/1963 | Blatt | 72/426 |
| 3,209,922 | 10/1965 | Melvin | 72/421 |
| 3,349,602 | 10/1967 | Nelson | 72/426 |
| 4,513,602 | 4/1985 | Sofy | 72/421 |

FOREIGN PATENT DOCUMENTS

| | | | |
|---|---|---|---|
| 2037753 | 2/1972 | Fed. Rep. of Germany | 72/426 |
| 803447 | 10/1958 | United Kingdom | 72/422 |
| 804127 | 2/1981 | U.S.S.R. | 72/427 |
| 1039617 | 9/1983 | U.S.S.R. | 72/426 |

*Primary Examiner*—Lowell A. Larson

*Attorney, Agent, or Firm*—Charles W. Chandler

[57] ABSTRACT

A linkage for controlling the removal of a workpiece from a press by controlling the timing between the workpiece support apparatus and the ram as it is raised and lowered. The linkage is connected to the ram in such a manner that the supporting apparatus has an adjustable dwell which can be adjusted by adjusting the length of both the linkage as well as a rod connected between the ram and the linkage.

8 Claims, 4 Drawing Figures

PRESS LINKAGE WITH CONTROLLED DWELL

BACKGROUND OF THE INVENTION

This invention is related to linkage means for connecting the motion of a workpiece supporting apparatus for moving a workpiece between the ram and bed of a press in such a manner as to provide a controlled timing of the support including a dwell enabling gripper means to engage the workpiece.

Some presses for working sheet metal are frequently automated so that the blank is inserted by a workpiece supporting apparatus to the opening between the ram and the bed of the press. There are also automated devices for removing the formed blank from the press after the ram has been raised. In order to provide a sufficient period of time for the gripper carried on the workpiece support means, to engage the blank it is desirable to have the connection between the press and the support means provide a dwell in the motion of the workpiece support means.

SUMMARY OF THE INVENTION

The broad purpose of the present invention is to provide an adjustable linkage for connecting the motion of a ram with a workpiece support means such that as the ram is being raised and lowered there is a dwell period when the workpiece support means is relatively stationary to permit gripper means to engage the blank prior to withdrawing it from the press.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
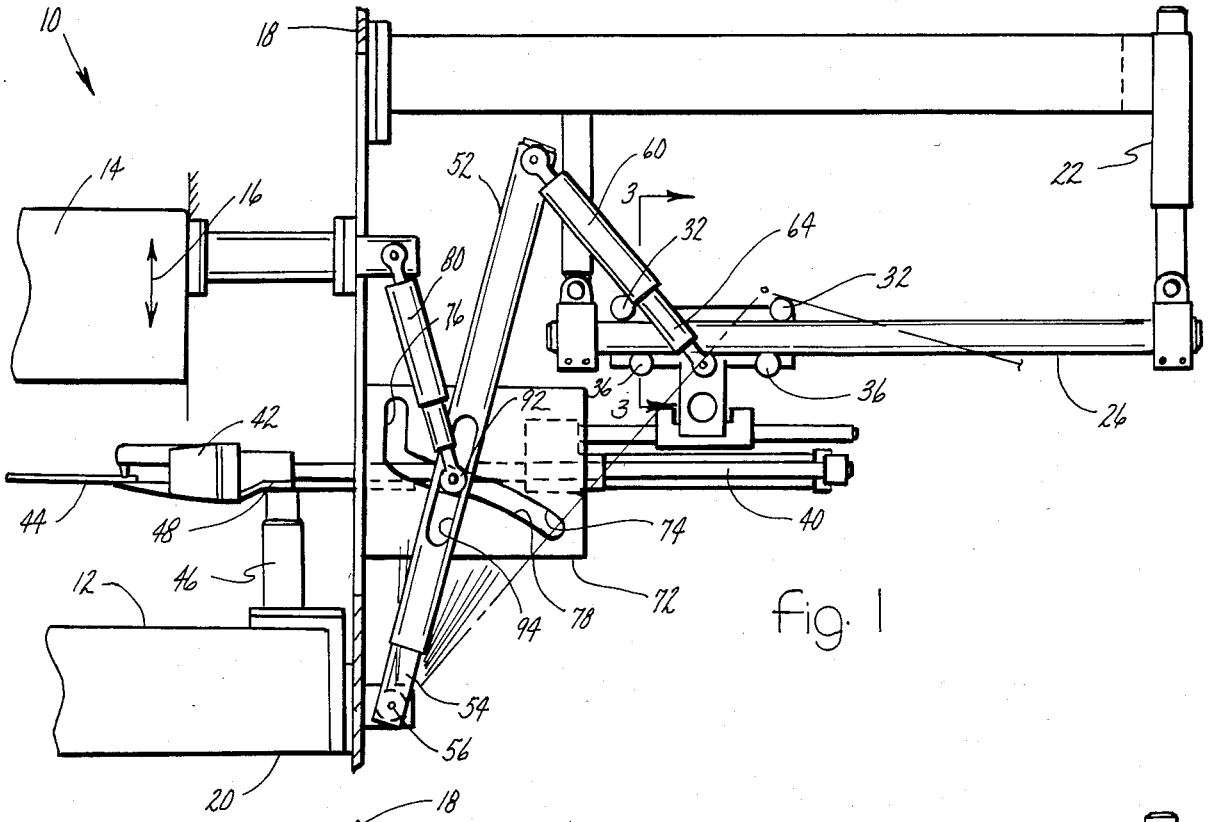
FIG. 1 is an elevational view of a press employing the preferred linkage means showing the gripper means disposed in the opening between the ram and the bed of the press.
Figure 2:
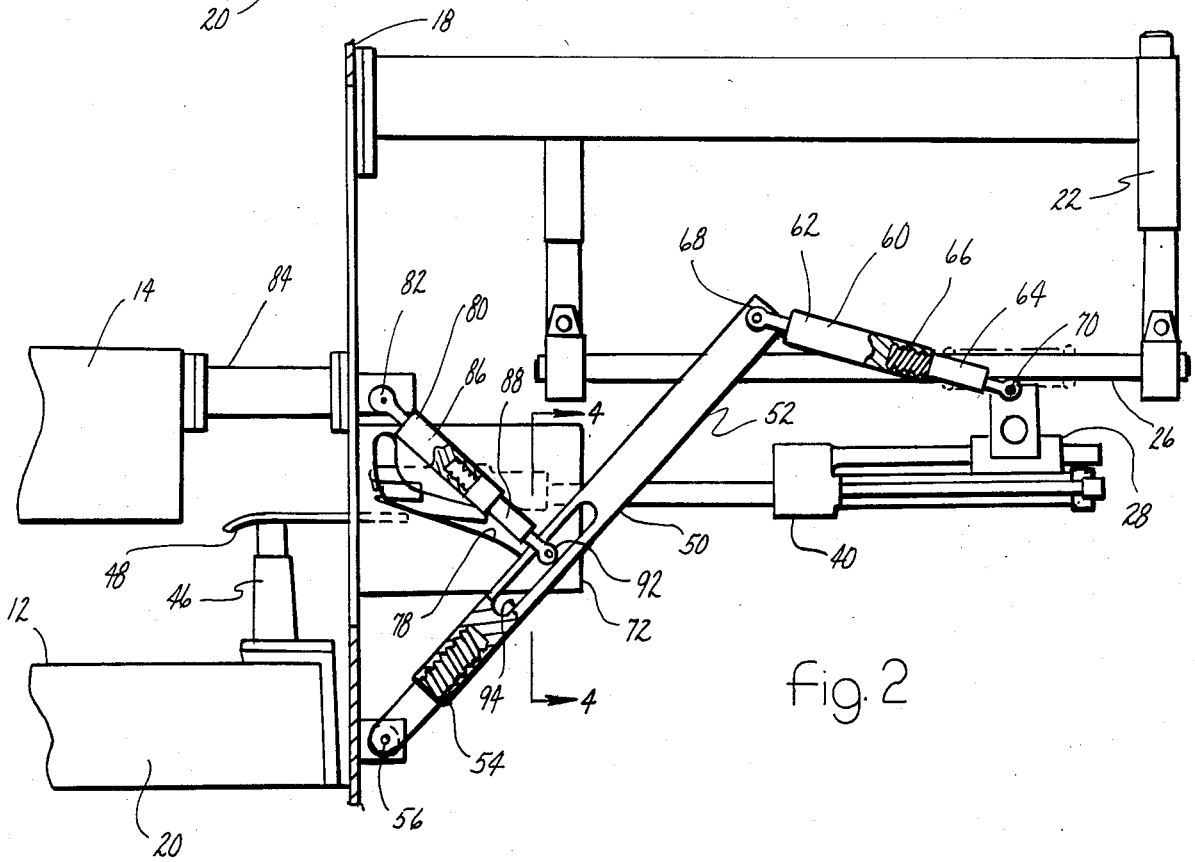
FIG. 2 is a view showing the gripper means at the opposite end of its stroke, removed from the press opening.
Figure 3:
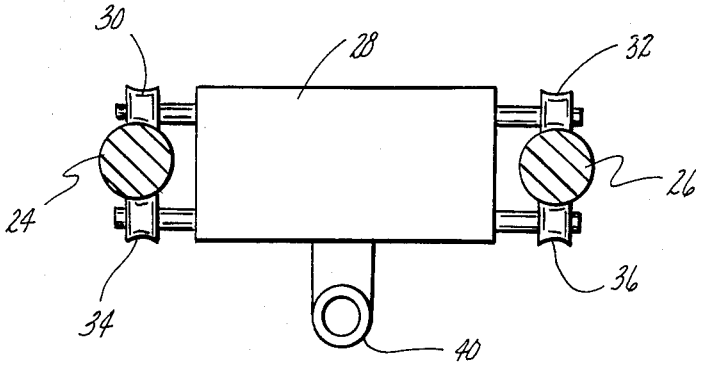
FIG. 3 is a view generally seen along lines 3—3 of FIG. 1.

Referring to the drawings, FIGS. 1 and 2 illustrate a press, generally indicated at 10, having a lower press member or die 12 and a upper press member or ram 14 slideably mounted in the conventional manner for motion in a vertical stroke in the direction of arrow 16.

Frame 18 is mounted on base 20 of the press and carries leg means 22 supporting a pair of rods 24 and 26. Carriage 28 carries upper roller means 30 which ride on rod 24, upper roller means 32 which ride on rod 26, lower roller means 34 which engage the lower side of the rod 24, and lower roller means 36 which engage the lower side of rod 26. The arrangement is such that the carriage is moveable in a horizontal position along a path of motion generally at right angles to the direction of motion 16 of ram 14.

Extractor arm 40 is carried by the carriage. Workpiece gripper means 42 are carried at the opposite end of the extractor arm. The gripper means are adapted to open and close by means not shown to engage sheet metal workpiece 44. Vertical leg means 46 are mounted on the bed of the press and carry skid member 48 to slideably support the extractor arm as it moves horizontally between its position adjacent the press and the position in which it is spaced from the press.

Link means 50 are connected between carriage 28 and ram 14. Link means 50 includes a link 52.

A lower link section 54 is threadably engaged with an opening in the lower end of link 52. Pivot means 56 pivotally connect the lower link member to frame 18 so that link means 50 can be pivoted between a generally vertical position in which the upper end of link member 52 is closely adjacent frame 18, and a lower position in which the link 52 is pivoted toward the right as viewed in FIG. 2.

Link members 52 and 54 are threadably connected together so that their overall length can be adjusted.

Link means 60 comprises a link member 62 and a shorter link member 64 threadably connected together at 66 so that the overall length of link means 60 can be adjusted. Pivot means 68 connect link member 62 to link member 52 while pivot means 70 connect link member 64 to carriage 28. The arrangement is such that as the link means 60 is pivoted, link means 60 causes the extractor arm to move either toward the press or away from the press. As viewed in FIG. 2, as link member 50 is pivoted toward the left, the extractor arm moves toward the press, and as link member 50 is pivoted toward the right, the extractor arm moves away from the press.

Cam plate 72 is mounted on frame 18 adjacent the path of motion of the extractor arm. The cam plate has a cam slot 74, which as viewed in FIG. 1 has a generally vertical section 76 that is generally parallel to the direction of motion of ram 16, and an inclined portion 78 that is inclined with respect to the path of motion 16 of the ram. Connecting member 80 is connected by pivot means 82 to an arm 84 that is attached to ram 14. Connecting member 80 is also formed of two telescopically, threadably engaged members 86 and 88. The overall length of connecting member 80 can be adjusted by threadably adjusting member 88 with respect to member 86.

Figure 4:
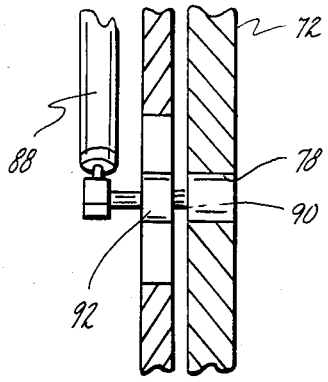
FIG. 4 is a view as seen along lines 4—4 of FIG. 2.

Referring to FIG. 4, a pair of cam rollers 90 and 92 are carried at the lower end of connecting member 88. Cam roller 90 is received in slot portion 78 while cam roller 92 is received in slot 94 provided in link member 52.

The arrangement is such that as ram 14 is raised, connecting member 80 causes link number 52 to pivot toward the ram and thus move the extractor arm toward workpiece 44 disposed in the press. The gripper means is actuated by means, not shown, to engage the workpiece. As the ram is raised further, there is a dwell in the motion of the extractor arm as the lower end of connecting link 80 moves up slot section 76. When the ram is lowered, roller 90 engages the bottom of slot section 76. Link 52 is moved toward the right as roller 90 moves in the inclined portion of the cam slot thereby causing the extractor arm to move away from the press. The arrangement is such that the two rollers in slots 94 and 78 move the extractor arm toward the press in a continuous motion which is interrupted when the ram approaches the top of its stroke for a sufficient time for the gripper means to engage and then withdraw the workpiece from the opening between the ram and the bed of the press.

It is to be understood that the timing can be changed by either increasing or reducing the overall length of connecting member 80, link means 52 or link means 60. Similarly, the timing arrangement can be changed by changing the cam plate to one having a slightly different cam contour.

Having described my invention, I claim:

1. The combination comprising:

a frame;

a first press member mounted on the frame;

a second press member mounted on the frame so as to be moveable with respect to the first press member along a first path of motion, between open and closed positions, the first press member and the second press member having an opening between them;

workpiece support means moveable toward positions depending on the position of the first press member and the second press member;

linkage means pivotally mounted on the frame and connected to the workpiece support means such that as the linkage means is pivoted in a first direction, the workpiece support means is moved along a path of motion with respect to the opening defined between the first press member and the second press member, the linkage means having a slot;

an elongated connecting member having a first end connected to the movable, second press member so as to be moveable therewith, and its opposite, second end connected to the slot in the linkage means so as to be moveable therewith;

a cam plate mounted on the frame, the cam plate having a slot; and follower means connected to the second end of the connecting member and received in the cam slot so as to follow the same whereby as the linkage means is pivoted in said first direction, the workpiece support means moves with respect to the moveable press member with a controlled rate of motion according to the slot in the cam plate.

2. A combination as defined in claim 1, in which the length of the linkage means is adjustable.

3. A combination as defined in claim 1, in which the linkage means has an elongated slot, and the follower means is moveably mounted in the slot of the linkage means such that the connecting member is moveable with respect to the linkage means during a portion of the motion of the second press member with respect to the workpiece support means.

4. A combination as defined in claim 3, in which the slot in the cam plate is formed such that the moveable press member is moveable during a portion of its stroke while the workpiece support means is in a relatively stationary position defined by the slot in the cam plate.

5. A combination as defined in claim 1, in which the moveable press member is moveable along a first path of motion and the workpiece support means is moveable along a second path of motion, generally at right angles with respect to the path of motion of the moveable press member.

6. The combination comprising:

a frame;

a ram mounted on the press for motion along a first path of motion;

a bed mounted on the frame in the path of motion of the ram such that the ram is relatively moveable with respect to the bed between an open position for receiving a workpiece and a closed position;

workpiece support means moveable toward a first position along a second path of motion for inserting a workpiece between the ram and the bed, and a second position for removing the workpiece from between the ram and the bed;

linkage means including a link member pivotally mounted on a frame and connected to the workpiece support means such that as the link is pivoted in a first direction, the workpiece support means is moved in a first direction along said second path of motion toward said first position, and as the link is pivoted in the opposite direction, the workpiece support means is moved along said second path of motion toward said second position, the link having a slot;

a connecting member connected to the ram so as to be moveable therewith;

first follower means mounted on the connecting member and moveably disposed in the slot in the link;

a cam member mounted on the frame, the cam member having a cam slot having a first portion generally parallel to said first path of motion of the ram, and a second portion that is not parallel to said first path of motion of the ram; and second follower means mounted on the connecting member and received in the cam slot so as to follow same whereby as the ram is moved along a first portion of said first path of motion, the workpiece support means is moved toward said first position between the ram and the bed, and as the ram is moved along a second portion of said first path of motion, the workpiece support means is stationary.

7. A combination as defined in claim 6, in which the length of the connecting rod is adjustable to adjust the length of travel of the workpiece support means along said second path of motion.

8. A combination as defined in claim 6, in which the length of the link is adjustable.

* * * * *